US009103073B2

(12) United States Patent
Vorderbrück et al.

(10) Patent No.: US 9,103,073 B2
(45) **Date of Patent: *Aug. 11, 2015**

(54) SYSTEM FOR FASTENING A RAIL, AND FASTENING OF A RAIL ON A SUBSTRATE

(75) Inventors: Dirk Vorderbrück, Werdohl (DE); Winfried Bösterling, Neuenrade (DE)

(73) Assignee: Vossloh-Werke GmbH, Werdohl (DE)

( * ) Notice: Subject to any disclaimer, the term of this patent is extended or adjusted under 35 U.S.C. 154(b) by 1285 days.

This patent is subject to a terminal disclaimer.

(21) Appl. No.: 12/866,162

(22) PCT Filed: Feb. 22, 2008

(86) PCT No.: PCT/EP2008/052209

§ 371 (c)(1),
(2), (4) Date: Dec. 1, 2010

(87) PCT Pub. No.: WO2009/103349

PCT Pub. Date: Aug. 27, 2009

(65) Prior Publication Data

US 2011/0061229 A1 Mar. 17, 2011

(51) Int. Cl.

| | |
|---|---|
| ***E01B 9/30*** | (2006.01) |
| ***E01B 9/66*** | (2006.01) |
| *E01B 9/68* | (2006.01) |

(52) U.S. Cl.

CPC . *E01B 9/303* (2013.01); *E01B 9/66* (2013.01); *E01B 9/686* (2013.01); *Y10T 29/53174* (2015.01)

(58) Field of Classification Search

USPC ..... 29/244; 238/349

See application file for complete search history.

(56) References Cited

U.S. PATENT DOCUMENTS

| | | | | | |
|---|---|---|---|---|---|
| 1,126,533 | A | * | 1/1915 | Liebmann | 238/304 |
| 2,980,336 | A | * | 4/1961 | Doll | 238/349 |
| 3,028,099 | A | * | 4/1962 | Molyneux | 238/317 |
| 3,158,323 | A | * | 11/1964 | Sonneville | 238/283 |
| 3,164,323 | A | * | 1/1965 | Steele et al. | 238/349 |
| 3,610,526 | A | * | 10/1971 | Burwell | 238/310 |
| 3,724,754 | A | * | 4/1973 | Molyneux et al. | 238/349 |
| 3,784,097 | A | * | 1/1974 | Landis | 238/310 |
| 3,796,369 | A | * | 3/1974 | Faville | 238/349 |
| 3,799,437 | A | * | 3/1974 | Scherbaum | 238/349 |
| 3,831,842 | A | * | 8/1974 | Tamura | 238/349 |

(Continued)

FOREIGN PATENT DOCUMENTS

| | | |
|---|---|---|
| CN | 2665195 Y | 12/2004 |
| DE | 2410903 | 9/1974 |

(Continued)

*Primary Examiner* — Lee D Wilson
*Assistant Examiner* — Alvin Grant
(74) *Attorney, Agent, or Firm* — The Webb Law Firm

(57) ABSTRACT

A system and a method for fastening a rail to a substrate, with a guide plate for laterally guiding the rail that has a standing surface associated with the substrate, a support element to support the guide plate in the assembly position, a spring element supported on the guide plate and at least one spring arm for exerting a resilient holding force onto the foot of the rail, and a tensioning means for tensioning the spring element. The fastening can be assembled in that the support element has a support lug supported on the substrate in the assembly position to reach under the standing surface of the guide plate in a way that the guide plate is supported on the substrate via the support lug in the region where the guide plate and support lug overlap.

16 Claims, 5 Drawing Sheets

(56) References Cited

U.S. PATENT DOCUMENTS

| | | | | | |
|---|---|---|---|---|---|
| 3,923,245 | A * | 12/1975 | Marchant | 238/347 |
| 4,193,544 | A * | 3/1980 | Marchant et al. | 238/347 |
| 4,312,477 | A * | 1/1982 | Hixson | 238/304 |
| 4,312,478 | A | 1/1982 | Matsuo et al. | |
| 4,350,290 | A * | 9/1982 | Bush | 238/17 |
| 4,353,503 | A * | 10/1982 | Duchemin | 238/349 |
| 4,448,349 | A * | 5/1984 | Wozniak | 238/62 |
| 4,569,478 | A * | 2/1986 | Bryan | 238/349 |
| 4,705,215 | A * | 11/1987 | Eisenberg et al. | 238/349 |
| 4,765,106 | A * | 8/1988 | Modrovich | 52/365 |
| 4,907,740 | A * | 3/1990 | Oberweiler et al. | 238/283 |
| 4,967,954 | A * | 11/1990 | von Lange | 238/310 |
| 5,123,596 | A * | 6/1992 | Fisher et al. | 238/342 |
| 5,125,573 | A * | 6/1992 | Vanotti | 238/351 |
| 5,344,072 | A * | 9/1994 | Molyneux | 238/341 |
| 6,257,495 | B1 * | 7/2001 | Eisenberg | 238/349 |
| 6,293,473 | B1 | 9/2001 | Ortwein et al. | |
| 6,880,764 | B2 * | 4/2005 | Schwarzbich | 238/287 |
| 6,904,847 | B2 * | 6/2005 | Bielka | 104/307 |
| 7,124,525 | B2 * | 10/2006 | Green et al. | 40/590 |
| 7,389,940 | B2 * | 6/2008 | Kurzo | 238/310 |
| 8,052,068 | B1 * | 11/2011 | Renneckendorf et al. | 238/349 |
| 8,181,887 | B2 * | 5/2012 | Seifert et al. | 238/310 |
| 8,210,444 | B2 * | 7/2012 | Osler | 238/283 |
| 8,359,934 | B2 * | 1/2013 | Ehmke et al. | 73/862.041 |
| 8,727,230 | B2 * | 5/2014 | Bednarczyk et al. | 238/349 |
| 2004/0154200 | A1 * | 8/2004 | Green et al. | 40/603 |
| 2004/0216963 | A1 * | 11/2004 | Kurzo | 187/408 |
| 2005/0017085 | A1 * | 1/2005 | Reichel et al. | 238/7 |
| 2005/0072522 | A1 | 4/2005 | Hayashi et al. | |
| 2005/0103878 | A1 * | 5/2005 | Bielka | 238/10 R |
| 2008/0257972 | A1 * | 10/2008 | Vorderbruck et al. | 238/331 |
| 2009/0084864 | A1 * | 4/2009 | Bosterling et al. | 238/349 |
| 2010/0200666 | A1 * | 8/2010 | Bosterling et al. | 238/310 |
| 2010/0243752 | A1 * | 9/2010 | Bosterling et al. | 238/349 |

FOREIGN PATENT DOCUMENTS

| | | | |
|---|---|---|---|
| DE | 2600416 | | 3/1977 |
| DE | 3324225 | A1 | 1/1985 |
| DE | 8505011 | U1 | 2/1988 |
| DE | 20122524 | U1 | 2/2006 |
| EP | 0794289 | A1 | 9/1997 |
| EP | 0758418 | B1 | 5/1998 |
| EP | 1013827 | A1 | 6/2000 |
| EP | 2600416 | A2 | 6/2013 |
| GB | 906869 | | 9/1962 |
| GB | 2351515 | A | 1/2001 |
| JP | 2000328501 | A | 11/2000 |
| JP | 2003503608 | A | 1/2003 |
| JP | 200819649 | A | 1/2008 |
| RU | 2276674 | C2 | 5/2006 |
| RU | 2300599 | C2 | 6/2007 |
| WO | 9729240 | A1 | 8/1997 |
| WO | 03046284 | A1 | 6/2003 |
| WO | 2007082553 | A1 | 7/2007 |

* cited by examiner

SYSTEM FOR FASTENING A RAIL, AND FASTENING OF A RAIL ON A SUBSTRATE

BACKGROUND OF THE INVENTION

1. Field of the Invention

The invention relates to a fastening system and to a fastening of a rail on a substrate. The system comprises in this case in general form the components required for fastening the rail, whereas the fastening of the rail relates to the specific assembly of the rail, such as is provided under practical conditions.

2. Description of the Related Art

Fastening systems and fastenings of this type are described for example in German patent application publication DE 33 24 225 A1 or German utility model DE 201 22 524 U1. They serve in particular to support a rail on what is known as a fixed substrate. Fixed substrates of this type are also referred to as a "slab track" and have, in contrast to a superstructure formed from loose ballast, no inherent resilience. The fixed substrate itself can in this case be formed for example by concrete slabs, on which the rails are directly assembled, or by sleepers which are likewise made of solid material, such as concrete.

In particular when the fastening system comprises sleepers which form the substrate on which the rails are to be fastened, lateral stop shoulders are generally moulded onto these sleepers. The stop shoulders delimit on the one hand, laterally between themselves, an aperture in which the rail and the components required for fastening thereof sit. On the other hand, the shoulders serve as stops against which the guide plates, which are intended for laterally guiding the rail in question, are supported.

Suitable fastening elements, generally screws, are used to fix these guide plates either directly to the fixed substrate or the respective sleeper or to fix them to the substrate via interposed components, such as force distribution plates. Conventionally, the fastening elements additionally serve to tension spring elements which exert a holding force, which is directed in the direction of the fixed substrate, onto the rail foot. Depending on the shaping of the substrate and the fastening means used, additional underlay and fastening means are required to correctly orient and hold the rails.

The known fastening systems ensure secure holding of the rails of a track body even under very high loads such as occur during high-speed operation. Owing to the large number of elements required for each individual fastening point, the costs for manufacturing and assembling a fastening system of this type are however considerable.

The large number of constructional elements which are required, in conventional fastening systems of the type described hereinbefore, for fastening the rail on a fixed track also lead to exact setting of the rail gauge being able to be brought about only with great difficulty. Such settings of the track can be required owing to insufficient precision of the concrete sleepers generally used for supporting the rails or variations in the dimensions of other fastening and support elements. Likewise, it can be necessary, in sections of track subjected to particularly high loads, to readjust after a specific operating time the spacing, forming the rail gauge, of the rails of the respective track body.

In DE 33 24 225 A1, which was mentioned at the outset, or German utility model DE 201 22 524 U1, which has also been mentioned hereinbefore, it has been proposed to provide, for compensating for production tolerances and for exact setting of the rail gauge, a support element which is arranged between the guide plate and the stop which accommodates the lateral forces occurring as a vehicle travels over the rail during practical operation. This support element is in this case embodied in a wedge-shaped manner in such a way that, as a result of displacement of the support element, the guide plate is moved more or less intensively in a direction directed transversely to the longitudinal extension of the rail. In order to prevent accidental displacement of the support element as a consequence of the lateral forces occurring during practical operation, the support element and the guide plate are in this case each provided with projections and recesses via which the guide plates are coupled to the respective support element in a form-fitting manner. Under normal operating conditions, the forces transmitted by the guide plate via this form-fitting connection are sufficient to hold the support element in its position by self-locking.

Nevertheless, correct functioning of the known fastening systems, which are suitable for compensating for production tolerances in the manner described hereinbefore, requires these systems to be assembled and maintained with great care and precision. Practical experience has shown that these requirements often cannot be met owing to the available staff being insufficiently qualified, inadequate assembly technology or harsh weather conditions. In such cases, it can occur, despite all preventative design measures, that the connection of the support element and guide plate becomes detached as a consequence of incorrect assembly or wear and the support element moves automatically out of its correct position.

A change in the position of the support element has been found to be particularly problematic when the rail is mounted on a resilient pad. Pads of this type are used to impart to the respective fastening point defined resilience in the direction of gravity as a rail vehicle travels over the rail. This resilience greatly lengthens the service life of the rail. However, the movement is accompanied by a movement also of all other elements of the fastening system. An imprecise, loosely positioned support element increases the play with which this movement can be carried out and thus causes as a result increasing wear.

SUMMARY OF THE INVENTION

Against this background, the invention was based on the object of providing a system for fastening a rail that can be assembled in a simple manner in such a way as to ensure sufficient positional securing of the support element. The invention also seeks to specify a fastening for a rail which can be securely mounted in a simple manner even under disadvantageous assembly and operating conditions.

According to the invention, this object has been achieved, in relation to a system for fastening a rail on a substrate, which system comprises a guide plate which is provided for laterally guiding the rail and has a standing surface associated with the substrate, a support element which is provided to support the guide plate in the assembly position, on its side remote from the rail, against a stop and has for this purpose an abutment surface associated with the guide plate and a support surface associated with the stop, a spring element which is provided to be supported on the guide plate and at least one spring arm for exerting a resilient holding force onto the foot of the rail, and a tensioning means for tensioning the spring element, in that the support element has a support lug which is provided to be supported on the substrate in the assembly position and in the process to reach under the standing surface of the guide plate in such a way that the guide plate is supported on the substrate via the support lug in the region in which the guide plate and support lug overlap.

Correspondingly, according to the invention, the above-specified object has been achieved, in relation to a fastening of a rail on a substrate, which system comprises a guide plate which stands with its standing surface on the substrate and laterally guides the rail, a support element which abuts with an abutment surface against a corresponding abutment surface of the guide plate and is supported with a support surface on a stop, a spring element which is supported on the guide plate and exerts with at least one spring arm a resilient holding force onto the foot of the rail, and a tensioning means by which the spring element is braced against the guide plate, in that the support element has a support lug which is supported on the substrate and in the process reaches under the standing surface of the guide plate in such a way that the guide plate is supported on the substrate via the support lug in the region in which the support lug and the guide plate overlap.

The central idea of the invention consists in the fact that, in a fastening system according to the invention and a fastening according to the invention, the guide plate stands on the support element. The support element is in this way loaded over a large area by the force which acts in the direction of gravity and by which the guide plate is also held in its position. In this way, any accidental raising of the support element is reliably prevented even when the support element has not been optimally assembled or material wear has over the course of time started to occur, as a result of which the friction prevailing between the support element and guide plate decreases.

The assembly of a system according to the invention to form a fastening according to the invention is in this case particularly simple. This is achieved in that the lug, which is present in accordance with the invention on the support element, is embodied in such a way that it in the assembly position reaches below the guide plate. Accordingly, after corresponding positioning of the support element, the guide plate must merely be attached to the respective portion of the support element. This can be carried out in an optimally simple movement requiring neither special knowledge nor special tools.

In a fastening system according to the invention, not only are the support element and the guide plate therefore connected to each other in a form-fitting manner, but rather this form-fitting connection is superimposed with a force-fitting connection which is caused by the tensioning forces exerted by the guide plate onto the support portion of the support element and reliably prevents automatic detachment of the support element and guide plate from their correct assembly position.

The invention thus provides a system and a rail fastening which can not only be assembled in a particularly simple manner, but rather which also ensure that the support element performs its secure function in interplay with the guide plate even under disadvantageous operating and weather conditions.

The invention is particularly suitable for fastening systems and fastenings of the type in which the rail is fastened on a sleeper which serves as the substrate and onto which is moulded a shoulder which forms the stop on which the support element is supported. It is however also conceivable to mould a corresponding stop onto an extensive plate or to form such a stop by an additional angular element assembled on a sleeper or a plate.

A channel, which extends in the longitudinal direction of the rail to be fastened at the transition to the stop, can be shaped in a manner known per se into the respective sleeper or plate. In the prior art, a lug of the guide plate engages with this channel to secure the position of the guide plates by a form-fitting fit in a direction oriented transversely to the rail. If a channel of this type is shaped into the sleeper, then the support lug of the support element is, in a system according to the invention, embodied in such a way that it sits in the channel in the fully assembled state. The channel can thus additionally be used to secure the position of the support element.

In principle, it is conceivable to embody the support lug of the support element in such a way that it covers the guide plate over its entire standing surface, i.e. the guide plate stands fully on the support lug. However, a material-saving configuration, which is easier to assemble, of the invention is characterised in that the guide plate has in the region of its side portion associated with the support element an aperture with which the support lug of the support element engages. This aperture extends preferably over the entire length, measured in the longitudinal direction of the rail, of the support element. In this way, the support element and the guide plate can be displaced relative to each other in the longitudinal direction of the rail, during assembly in the state placed onto the substrate, until their correct position is reached. The support portion acts in this case in the manner of a guide rail. This function can additionally be supported in that the apertures have at least two portions which are offset from one another in a stage-like manner and are of differing depth, measured transversely to the longitudinal extension of the rail, and the support portion of the support element is shaped in such a way that it abuts against the surfaces of the lugs of the aperture in a form-fitting manner. Optimum supporting of the guide plate is obtained in this case when the deepest portion of the aperture is associated with the substrate. In a multiple-stage embodiment of the aperture, the area of friction between the support element and the guide plate is also increased in size, as a result of which, after bracing of the guide plate on the substrate, further improved security is attained during the positional securing of the support element.

In cases in which the guide plate does not have in the region of its respective side portion a standing surface extending over the entire length thereof, but rather there are embodied there merely supports via which the guide plate is supported on respectively limited standing surfaces, it is sufficient to design these supports so as to be sufficiently short that they stand in the fully assembled state on the support lug of the support element, whereas the remaining standing surface of the guide plate rests on the respective substrate.

In principle, it is conceivable to provide, to compensate for tolerances of the dimensions of the rail, position of the respective stop, etc., right parallelepiped support elements, the thickness of which is in each case designed in such a way as to fill the respective spacing between the guide plate and the stop. Although such a solution presupposes that the assembler has at his disposal in each case a sufficient number of support elements of differing thickness, from which he selects the particular support element required in each individual case, a simplified configuration, which is in particular suitable for automated assembly, of the system according to the invention is nevertheless obtained when the support element is, in accordance with the model of the prior art, embodied in a wedge-shaped manner. In this case, the abutment surface and the support surface of the support element are in each case oriented relative to each other in such a way that they enclose an acute angle.

The positional securing of the support element can additionally be supported in that mutually corresponding shaped elements are embodied on the support element and the guide plate for connecting the support element and shaped element in a form-fitting manner.

For this purpose, the shaped elements can be configured as protruding ribs and receding, correspondingly shaped apertures. These can be embodied, for example on the abutment surface of the support element, as strip-like projections and/or recesses which can be coupled in a form-fitting manner to at least one correspondingly shaped projection and/or recess which is shaped on the abutment surface, associated with the respective abutment surface of the support element, of the guide plate.

Preferably, more than one shaped element of this type are in this case embodied on the abutment surface associated with the guide plate. In this way, a system according to the invention meets the conditions that, in a fastening according to the invention, the guide plate and the support element are connected to each other in a particularly secure manner and large friction surfaces are provided via which the self-locking which exists after assembly prevents accidental displacement of the support element in the fully assembled state.

Particularly advantageous use properties of a system according to the invention are obtained in this connection when the shaped elements in question extend substantially parallel to the standing surface of the guide plate. This configuration has the advantage that the support element and guide plate, when placed on the substrate, can still move relative to each other without difficulty, to find their desired position.

Further increased protection from accidental displacement can be attained in that the shaped elements extend substantially perpendicularly to the standing surface of the guide plate. In the assembly position, the shaped elements, which are oriented and engage with one another in this way, prevent any displacement of the support element in the longitudinal direction of the guide plate.

The effectiveness of the application of the holding force, which is transmitted by the guide plate, to the support element can be further improved in that a load portion, which in the assembly position rests on the free upper side of the support element, is embodied on the guide plate. In the case of this configuration of the invention, as an alternative or in addition to an arrangement of the abutment surfaces, which are associated with one another for the supporting, form-fitting connection of the support element and guide plate thereon, shaped elements for connecting on the free upper side of the support element in a form-fitting manner can be embodied in the region which in the assembly position is covered by the load portion of the guide plate.

If secure guidance of the respective rail vehicle on the rail to be fastened using the system according to the invention requires the rail to be positioned obliquely to a certain degree, then this can be brought about, in a system according to the invention, in that there is provided a base plate via which the rail to be fastened can be supported on the fixed substrate, wherein this base plate has a standing surface, associated with the fixed substrate, and a support surface associated with the underside of the rail foot of the rail to be fastened, and the support surface is oriented, viewed in cross section, inclined at an angle relative to the standing surface.

In particular in the case that a base plate is present, a projection, which in the assembled state reaches under the base plate or the rail foot, can be embodied on the side of the guide plate that is associated with the rail to be fastened. This projection prevents in a particularly secure but nevertheless simple manner raising of the guide plate under disadvantageous operating conditions. If there is provided a resilient intermediate layer on which the base plate lies in the fully assembled state of the system according to the invention, an aperture, with which the projection engages in the assembly position, can be formed for this purpose on the intermediate layer.

BRIEF DESCRIPTION OF THE DRAWINGS

The invention will be described hereinafter in greater detail with reference to drawings which illustrate an exemplary embodiment and in which.

DETAILED DESCRIPTION OF THE PREFERRED EMBODIMENTS

Figure 1A:
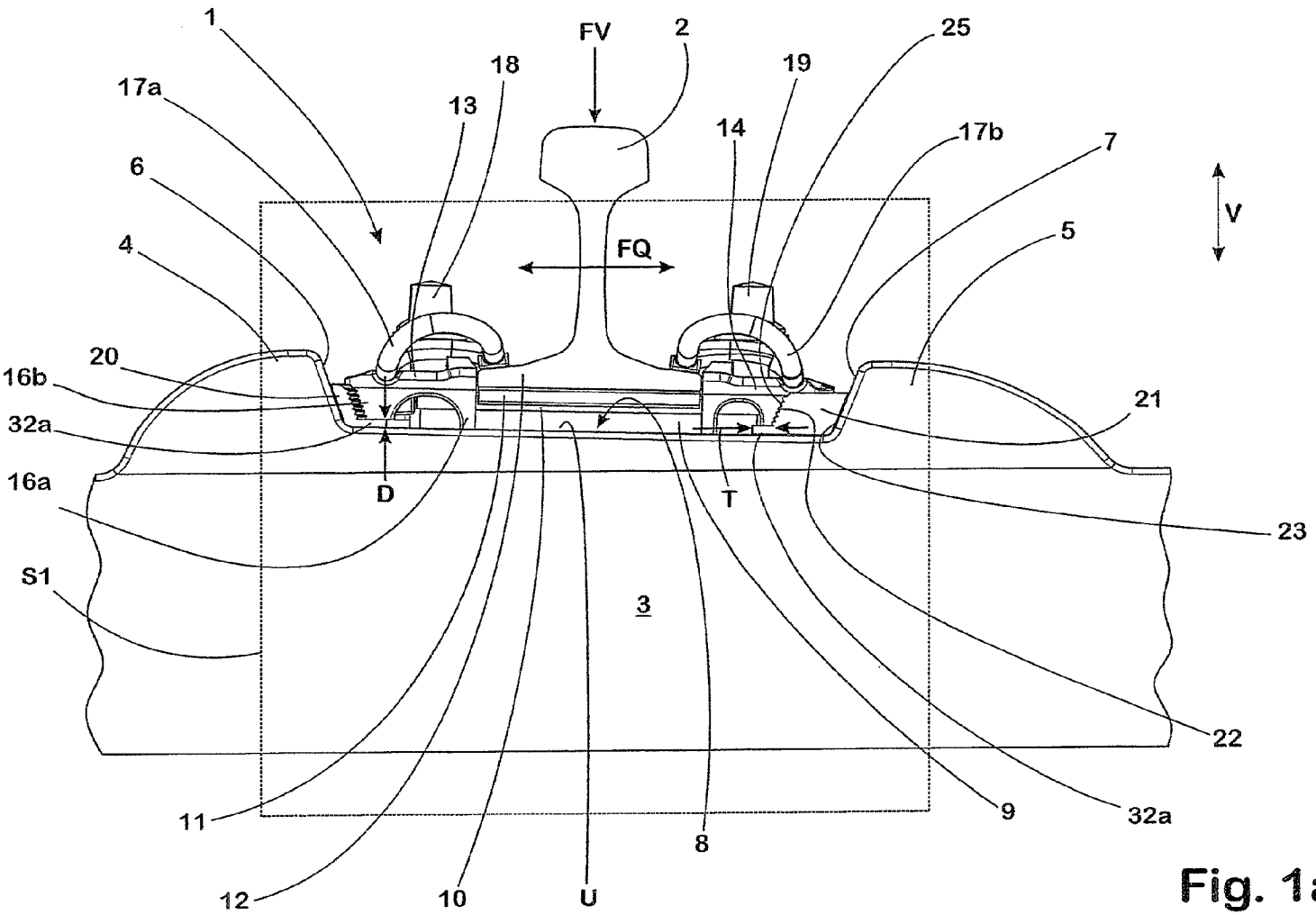
FIG. 1*a* is a lateral view of a first system for fastening a rail.

The respective fastenings 1 shown in the figures of a respective rail 2 on a fixed substrate U have each been produced by means of a system S1, S2, S3, S4 for fastening the respective rail 2.

The systems S1, S2, S3, S4 each comprise a sleeper 3 which is preproduced from concrete and on the free upper side of which two stops 4, 5 are shaped, set apart from each other, in the form of hump-like elevations. The stops 4, 5 each have, on their mutually facing sides, a stop surface 6, 7 extending substantially parallel to the respective rail 2. In this way, the stops 4, 5 laterally delimit between themselves a receptacle 8 which extends transversely to the rail 2 and the flat base of which forms the substrate U on which the respective rail 2 stands.

In the systems S1, S2, S3 used for the fastenings 1 shown in FIGS. 1*a*-3*b*, the flat substrate U of the sleeper 3 merges, in each case in a groove K, gradually with the respective stop surface 6, 7 of the stops 4, 5. Conversely, in the fastening 1, which is shown in FIGS. 4*a*, 4*b* and formed from the system S4, in the region of the transition from the substrate U to the respective stop surface 6, 7, a channel R, which extends in the longitudinal direction L of the rail 2 via the sleeper 3, is shaped in each case into the sleeper 3.

Each of the fastening systems S1, S2, S3, S4 comprises in this case a resilient intermediate plate 9 resting directly on the substrate U. A base plate 10, which is made of steel, covers the intermediate plate 9 and distributes the loads which occur in practical use when a rail vehicle (not shown here) travels over the rail 2 and act on the base plate 10 via the rail 2, lies on the intermediate plate 9.

A further intermediate layer 11 is placed onto the base plate 10. The width of the further intermediate layer corresponds at most to the width of the rail foot 12 of the rail 2, which rail foot stands with its underside on the intermediate layer 11.

In order to set an inclination, which may be required, of the rail 2 relative to the fixed substrate U, the base plate 10 can have a wedge-shaped cross-sectional shape, wherein the upper side, associated with the rail foot 12, encloses with the underside, associated with the intermediate plate, of the base plate 10 an acute angle.

For laterally supporting the respective rail 2 with respect to the transverse forces which occur when a vehicle travels over the rail, a respective guide plate 13, 14 is arranged on both sides of the rail foot 12 in the systems S1, S2, S3, S4. The guide plates 13, 14 each have a support surface 15 abutting against the rail foot 12 and stand on the substrate U via corresponding, arrow-like support portions 16*a*, 16*b*.

On their lower portion, adjoining the surface of the fixed substrate U, there can be moulded onto the support surface 15 of the guide plates 13, 14 a cam-like projection (not shown here) which protrudes into a correspondingly shaped aperture (likewise not shown here) of the resilient intermediate plate 9 and in the process reaches below the base plate 10. In this way, the respective guide plate 13, 14 is held in a form-fitting manner in the vertical direction V. This reliably rules out raising of the guide plates 13, 14 from the substrate U even in the event of the occurrence of longitudinal forces FL or transverse forces FQ or vertical forces FV which are disadvantageous in this regard.

On their free upper sides, the guide plates 13, 14 have shaped elements which are shaped in a manner known per se and form guides for in each case a ω-shaped tensioning clamp 17*a*, 17*b* which serves as a spring element for bracing the rail 2 on the fixed substrate U. Tensioning means in the form of screws 18, 19, which are screwed into a dowel (not shown here) which is introduced into the fixed substrate U, are provided for tensioning the tensioning clamps 17*a*, 17*b*. The screws 18, 19 load in the process via their screw head the central portion of the respective tensioning clamp 17*a*, 17*b* in a manner known per se in such a way that the tensioning clamps 17*a*, 17*b* exert, via the free ends, resting on the upper side of the rail foot 12, of their arms, the required spring-resilient holding force onto the rail foot 12.

The guide plates 13, 14 are laterally supported via in each case a support element 20, 21 which is supported against the respective stop 4, 5. The support element 20, 21 each have a wedge-shaped basic shape which is triangular, viewed from above. In this case, their abutment surface 22, which is associated with the respective guide plate 13, 14 and runs in the assembly position obliquely to the rail 2, encloses with their support surface 23, which is associated with the respective stop 4, 5, viewed from above, an acute angle α1 of from 5-15°.

At the same time, the abutment surface 22 is inclined relative to the vertical in such a way that the support elements 20, 21 are wider in their lower portion, which is associated with the fixed substrate U, than in the region of their portion adjoining the free upper side 24 of the support elements 20, 21.

Associated with the abutment surface 22 of the support elements 20, 21 is in each case an inversely inclined abutment surface 25, which is oriented obliquely, based on the longitudinal extension of the rail 2, in accordance with the abutment surface 22, of the respective guide plate 13, 14. In each case mutually corresponding shaped elements, which extend in a slat-like manner over the width of the surfaces 22, 25 in question, in the form of depressions 26, 27 and projections 28, 29, are shaped into the abutment surface 22 of the support elements 20, 21 and the abutment surface 25 of the guide plates 13, 14 in such a way that the projections 28 of the respective support element 20, 21 engage with the depressions 26 of the respective guide plate 13, 14 and vice versa. Form-fitting coupling of the support elements 20, 21 to the respective guide plate 13, 14 is established in this way. The friction, which is established in the region of this form-fitting coupling as a consequence of the tensioning forces exerted by the respective screw 18, 19 onto the guide plates 13, 14, is so high that self-locking occurs and automatic migration of the support elements 20, 21 from their assembly position in the longitudinal direction L of the rail 2 is reliably prevented even under high transverse forces FQ.

The bracing of the guide plates 13, 14 against the respective support element 20, 21 is additionally supported in each case by a load portion 30 which protrudes in the direction of the respective support element 20, 21 and is formed onto the respective guide plate 13, 14 in the region of the transition from its abutment surface 25 to its upper side. The load portion 30 is in this case shaped and designed in such a way that it exerts, when the guide plates 13, 14 are fully assembled and braced, a compressive force onto the respective support element 20, 21.

In order to simplify the exact orientation of the support elements 20, 21 relative to the guide plates 13, 14 associated therewith, markings 31, which facilitate reading of the respective relative position, are provided on the support elements 20, 21 and the guide plates 13, 14.

Raising of the support elements 20, 21 in the vertical direction V as a consequence of the forces FV occurring as a vehicle travels over the rail 2 is prevented in the fastenings 1 in that there is moulded onto the support elements 20, 21 in each case a support lug 32*a*, 32*b*, 32*c*, 32*d* with which the respective support element 20, 21 reaches below the guide plate 13, 14 associated therewith.

Figure 1B:
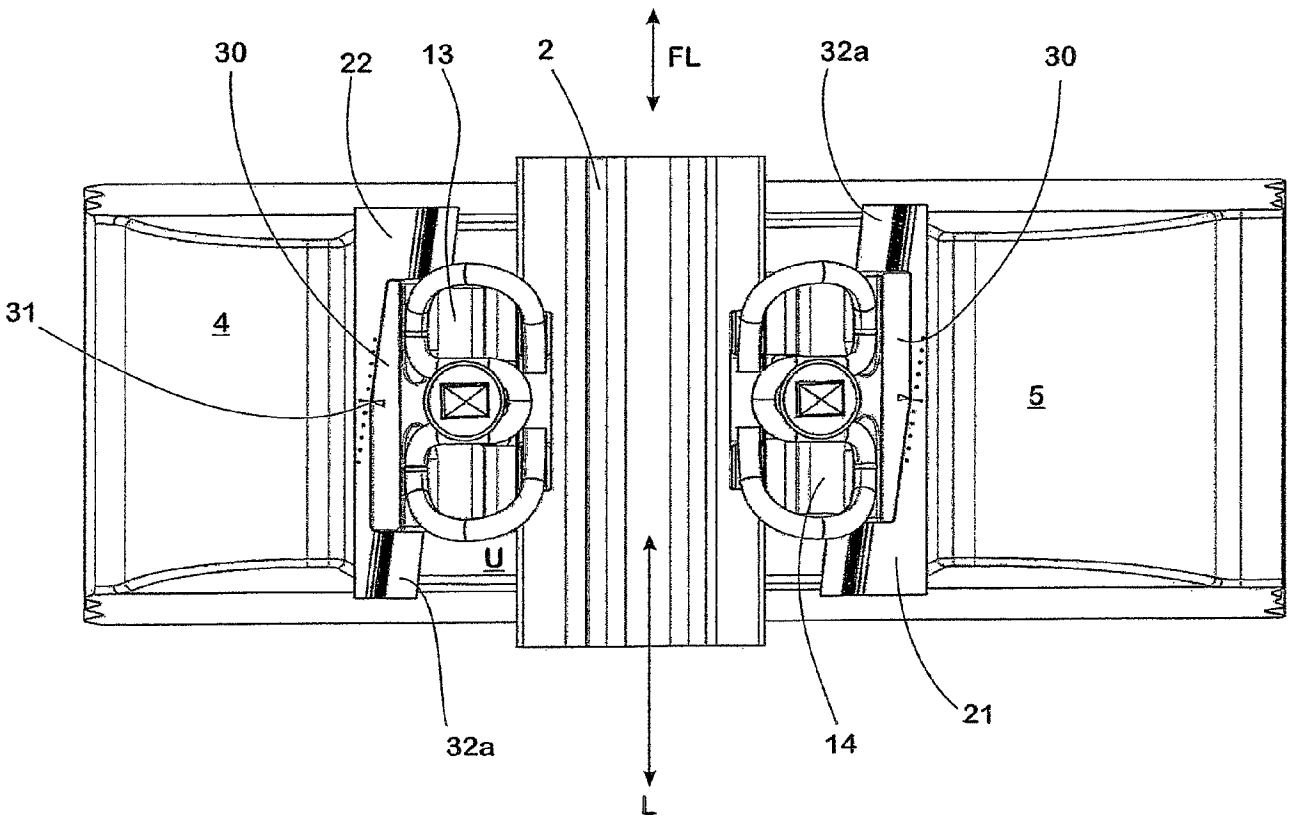
FIG. 1*b* is a view from above of the system according to FIG. 1*a;*

In the system S1 used for the fastening 1 illustrated in FIGS. 1*a*, 1*b*, the support lug 32*a* is embodied in the manner of a flat projection which extends over the entire width B of the respective support element 20, 21 and protrudes from the lower edge, associated with the substrate U, of the abutment surface 22 in the direction of the rail 2. The support lug 32*a* reaches in the process below the support portion 16*b*, which is associated with the respective support element 20, 21, of the respective guide plate 13, 14, so that the support portions 16*b* stand with their standing surfaces over the entire area of the support lug 32*a*. The support portions 16*b* are in this case shorter by the thickness D of the support lug 32*a* than the support lugs 16*a*, associated with the rail 2, of the respective guide plate 13, 14, which stand with their standing surfaces directly on the substrate U.

Figure 2A:
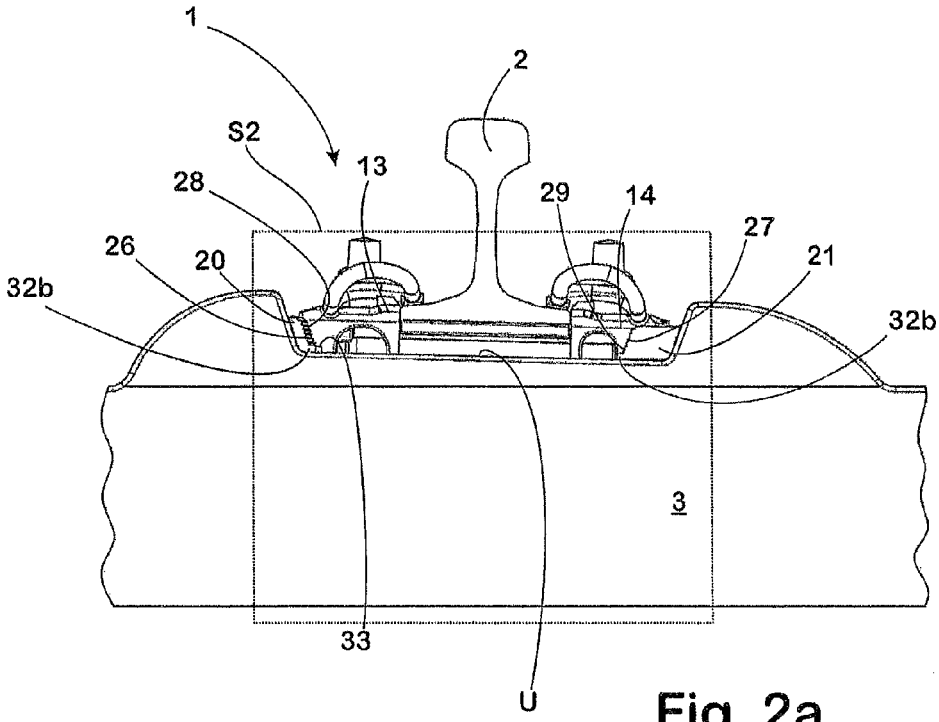
FIG. 2*a* is a lateral view of a second system for fastening a rail.
Figure 2B:
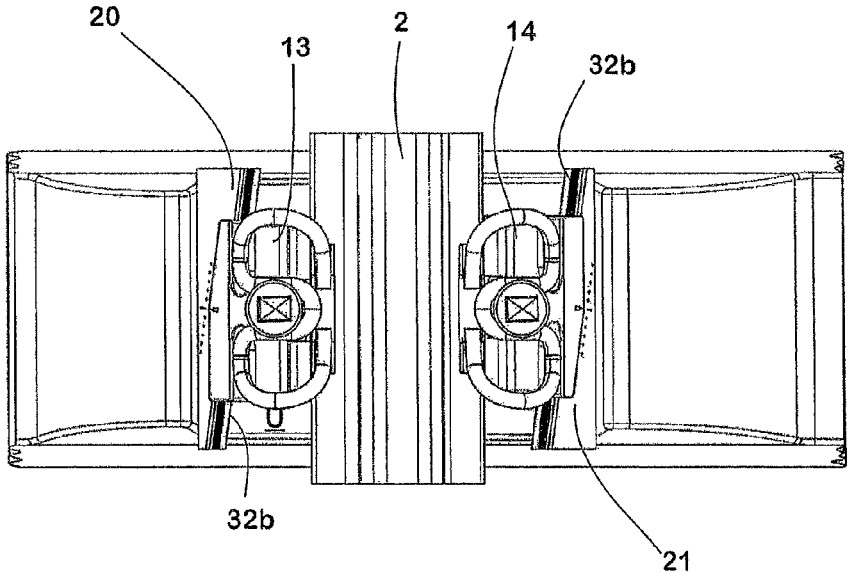
FIG. 2*b* is a view from above of the system according to FIG. 2*a;*

In the fastening 1 which is illustrated in FIGS. 2*a*, 2*b* and formed by the system S2, too, the respective support lug 32*b* of the support elements 32 is embodied in the manner of a flat projection which extends over the entire width B of the respective support element 20, 21 and protrudes from the lower edge, associated with the substrate U, of the abutment surface in the direction of the rail 2. However, unlike in the exemplary embodiment shown in FIGS. 1*a*, 1*b*, the support lug 32*b* does not here cover the respective support portion 16*b* over its entire standing surface, but rather engages merely with an aperture 33 which is shaped, starting from the standing surface, into the respective support portion 16*b*. In the guide plates 13, 14 of the system S2, the height of all support portions 16*a*, 16*b* is therefore the same and the support lug 32*b* of the support elements 20, 21 covers only part of the standing surface of the support portions 16*b* of the guide plates 13, 14.

Figure 3A:
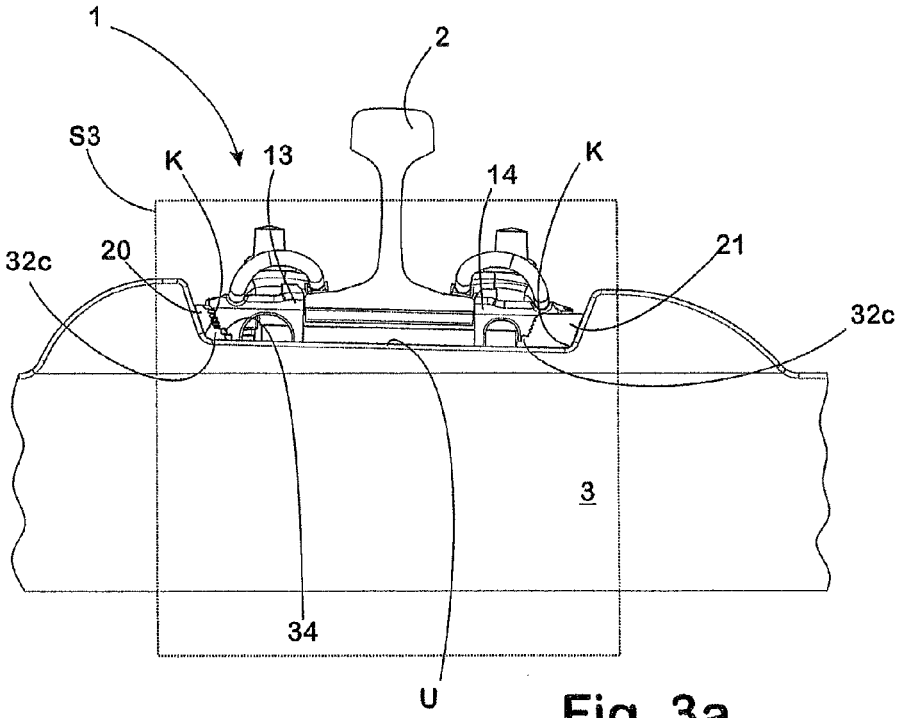
FIG. 3*a* is a lateral view of a third system for fastening a rail.
Figure 3B:
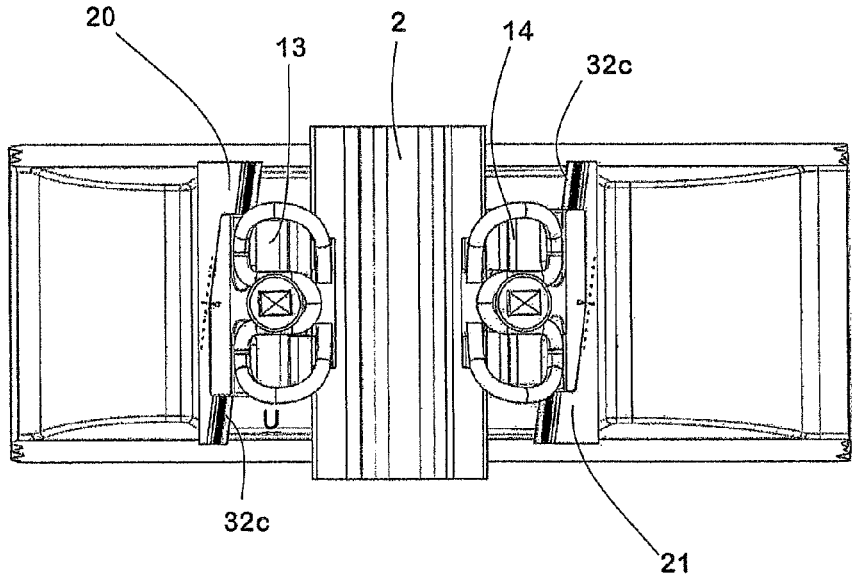
FIG. 3*b* is a view from above of the system according to FIG. 3*a;*
Figure 4A:
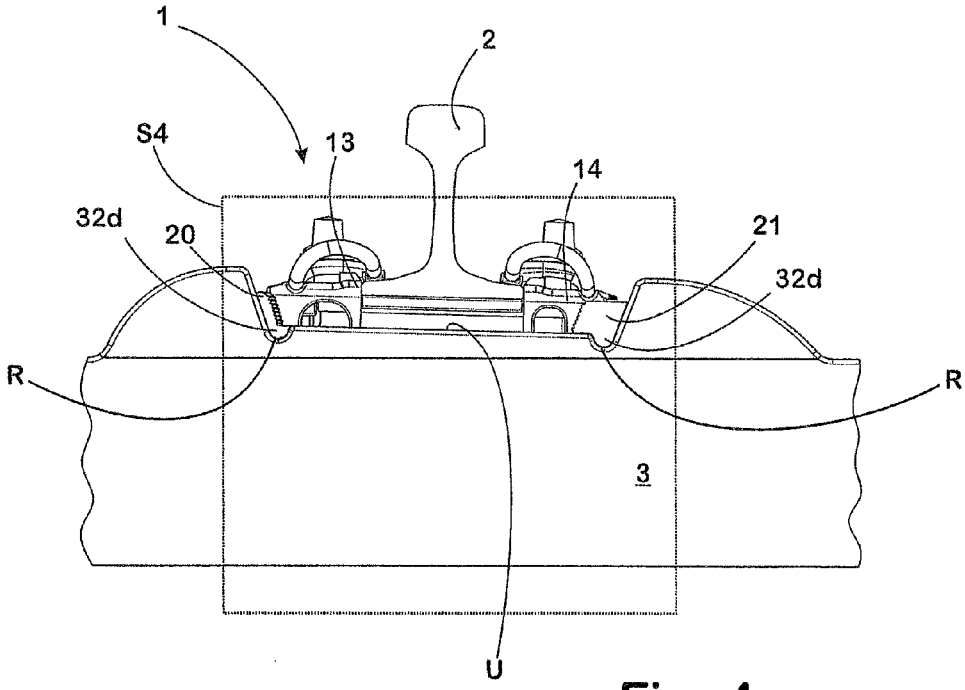
FIG. 4*a* is a lateral view of a fourth system for fastening a rail.
Figure 4B:
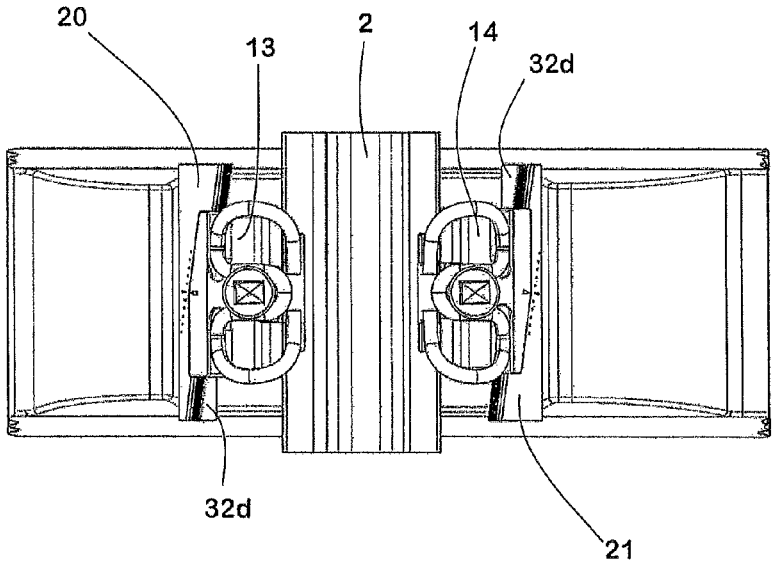
FIG. 4*b* is a view from above of the system according to FIG. 4*a.*

In the fastening 1 which is illustrated in FIGS. 3*a*, 3*b* and formed by the system S3, the respective support lug 32*c* of the support elements 32 is divided in a step-like manner into two stages which each extend over the entire width B of the respective support element 20, 21 and protrude from the lower edge, associated with the substrate U, of the abutment surface 22 in the direction of the rail 2. The lower of the two stages protrudes in this case further than the overlying stage. As in the exemplary embodiment shown in FIGS. 2*a*, 2*b*, the support lug 32*c* does not cover the respective support portion 16*b* over its entire standing surface, but rather engages merely with an aperture 32 which is shaped, starting from the standing surface, into the respective support portion 16*b*. The aperture 34 is in this case shaped in accordance with the grading of the support lug 32*c*, so that the support lug 32*c* is flush at its stages, in the fully assembled state, with the surfaces of the aperture 34. In the guide plates 13, 14 of the system S3 too, the height of all support portions 16*a*, 16*b* is therefore the same, and the support lug 32*c* of the support elements 20, covers here only part of the standing surface of the support portions 16*b* of the guide plates 13, 14.

In the fastening 1 which is illustrated in FIGS. 4*a*, 4*b* and formed by the system S4, the respective support lug 32*d* of the support elements 20, 21 is moulded onto the underside of the support elements 20, 21 in such a way that it fills, in the fully assembled state, the channel R of the sleeper 3. The support lug 32*d* protrudes from the lower edge of the support surface 23 and extends over the entire width B of the respective support element 20, 21. In this case, the dimensions of its depth T, measured transversely to the longitudinal direction L in the direction of the rail, are such that the support lug 32*d* projects beyond the abutment surface 22 of the support element in each case over approx. 50% of the width B of the support element. There is thus formed a standing surface which is triangular, viewed from above, and on which the respective guide plate 13, 14 of the system S4 stands with at least one of its support portions 16*b*. The support lug 32*d* thus reaches in each case likewise below only part of the guide plate 13, 14 associated therewith. However, as a result of the fact that the support lug 32*d* sits at the same time in the channel R, the respective support element 20, 21 is in this case not only securely held down by the guide plate 13, 14, but rather is also still guided in the channel R. As a result, this ensures maximum safety of the fixing of the support elements 20, 21 in their correct assembly position.

In order to reliably fill the space which is present between the respective guide plate 13, 14 and the respective stop surface 6, 7 of the stop 4, 5 associated respectively therewith, the support element 20, 21, which is arranged in each case between the stop 4, 5 in question and the respective guide plate 13, 14, can be displaced along the rail 2. For this purpose, the screw 18, 19, which braces the respective guide plate 13, 14 against the fixed substrate U, is detached sufficiently far that the self-locking becomes detached in the region of the form-fitting coupling of the respective support element 20, 21 to the respective guide plate 13, 14, and the support element 20, 21 in question can be displaced. As soon as the support element sits on both sides in a form-fitting manner between the respective stop surface 6, 7 of the stops 4, 5 and the stop surface 25 of the respective guide plate 13, 14, the respective fastening screw 18, 19 is retightened until the respective tensioning clamp 17*a*, 17*b* exerts the required holding force onto the rail foot 2*a* and—in conjunction therewith—the self-locking is established between the respective support element 20, 21 and the respective guide plate 13, 14.

In this way, the respective fastening system 1 can be adapted in a particularly simple manner to the respective relative position of the rail 2 and stops 4, 5, without the respective system S1, S2, S3, S4 having to be broken down into its individual parts for this purpose.

LIST OF REFERENCE NUMERALS

1 Fastenings of in each case a rail 2
2 Rail
2*a* Rail foot
3 Sleeper
4, 5 Stops
6, 7 Stop surface
8 Receptacle
9 Intermediate plate
10 Base plate
11 Intermediate layer
12 Rail foot
13, 14 Guide plates
15 Support surface of the guide plates
16*a*, 16*b* Support portions of the guide plates 13, 14
17*a*, 17*b* Tensioning clamps
18, 19 Screws
20, 21 Support elements
22 Abutment surface of the support elements 20, 21
23 Support surface of the support elements 20, 21
24 Free upper side of the support elements 20, 21
25 Abutment surface of the guide plates 13, 14
26, 27 Depressions
28, 29 Projections
30 Load portion
31 Markings
32*a*-32*d* Support lugs
33 Aperture
34 Aperture
B Width of the respective support element 21, 22
D Thickness of the support lug 32*a*
FL Longitudinal forces
FQ Transverse forces
FV Vertical forces
K Groove
L Longitudinal direction
R Channel
T Depth of the support lug 32*b*, 32*c*, 32*d*
U Fixed substrate

The invention claimed is:

1. A system for fastening a rail on a substrate, comprising:
a guide plate which is provided for laterally guiding the rail and has a standing surface configured to stand on the substrate;
a support element which is provided to support the guide plate in an assembly position, on a side remote from the rail, against a stop and has for this purpose an abutment surface associated with the guide plate and a support surface associated with the stop;
a spring element which is provided to be supported on the guide plate and at least one spring arm for exerting a resilient holding force onto a foot of the rail; and
a tensioning means for tensioning the spring element;
wherein the support element has a support lug which is provided to be supported on the substrate in an assembly position and to reach under the standing surface of the guide plate in such a way that the guide plate is supported on the substrate via the support lug in a region in which the guide plate and support lug overlap.

2. The system according to claim 1, further comprising a sleeper onto which is moulded a stop shoulder which forms the stop on which the support element is supported.

3. The system according to claim 2, wherein a channel, in which the support lug of the support element sits, is shaped into the sleeper.

4. The system according to claim 1, wherein the guide plate has in a region of a side portion associated with the support element an aperture with which the support lug of the support element engages.

5. The system according to claim 4, wherein the apertures have at least two portions which are offset from one another in a stage-like manner and are of differing depth, measured transversely to a longitudinal extension of the rail, and a support portion of the support element is shaped in such a way that the support portion abuts against surfaces of the lugs of the aperture in a form-fitting manner.

6. The system according to claim 5, wherein the deepest portion of the aperture is associated with the substrate.

7. The system according to claim 1, wherein the abutment surface and the support surface of the support element enclose an acute angle.

8. The system according to claim 1, wherein mutually corresponding shaped elements are embodied on the support element and the guide plate for connecting the support element and guide plate in a form-fitting manner.

9. The system according to claim 8, wherein the shaped elements are embodied on the abutment surface, associated with the support element, of the guide plate and the abutment surface, associated with the guide plate, of the support element.

10. The system according to claim 8, wherein the shaped elements are embodied as protruding ribs and receding, correspondingly shaped apertures.

11. The system according to claim 10, wherein the shaped elements extend substantially parallel to the standing surface of the guide plate.

12. The system according to claim 10, wherein the shaped elements extend substantially perpendicular to the standing surface of the guide plate.

13. The system according to claim 1, wherein a load portion, which in an assembly position rests on a free upper side of the support element, is formed on the guide plate.

14. The system according to claim 13, wherein shaped elements for connecting on the free upper side of the support element in a form-fitting manner are embodied in a region which in an assembly position is covered by the load portion of the guide plate.

15. A fastening of a rail on a substrate, comprising:

a guide plate which stands with a standing surface on the substrate and laterally guides the rail;

a support element which abuts with an abutment surface against a corresponding abutment surface of the guide plate and is supported with a support surface on a stop;

a spring element which is supported on the guide plate and exerts with at least one spring arm a resilient holding force onto a foot of the rail; and a tensioning means by which the spring element is braced against the guide plate;

wherein the support element has a support lug which is supported on the substrate and in the process reaches under the standing surface of the guide plate in such a way that the guide plate is supported on the substrate via the support lug in a region in which the support lug and the guide plate overlap.

16. The fastening according to claim 15, wherein the substrate is formed by a sleeper onto which is moulded a stop shoulder which forms the stop on which the support element is supported.

* * * * *